US009260266B2

(12) United States Patent
Föhr et al.

(10) Patent No.: US 9,260,266 B2
(45) Date of Patent: Feb. 16, 2016

(54) METHOD FOR SEPARATING PARTIAL WEBS IN A SLITTER WINDER

(71) Applicants: Heikki Föhr, Järvenpää (FI); Tommi Vuoristo, Tuusula (FI)

(72) Inventors: Heikki Föhr, Järvenpää (FI); Tommi Vuoristo, Tuusula (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 136 days.

(21) Appl. No.: 14/010,154

(22) Filed: Aug. 26, 2013

(65) Prior Publication Data

US 2014/0061358 A1 Mar. 6, 2014

(30) Foreign Application Priority Data

Aug. 29, 2012 (EP) ..... 12182171

(51) Int. Cl.
*B65H 35/02* (2006.01)
*B65H 23/025* (2006.01)

(52) U.S. Cl.
CPC ..... *B65H 35/02* (2013.01); *B65H 23/0258* (2013.01); *B65H 2301/351* (2013.01); *B65H 2301/4148* (2013.01); *B65H 2404/111* (2013.01); *B65H 2404/511* (2013.01); *B65H 2511/216* (2013.01); *B65H 2511/232* (2013.01); *B65H 2801/84* (2013.01)

(58) Field of Classification Search
CPC ..... B65H 35/02; B65H 23/0258; B65H 2301/351; B65H 2301/4148
USPC ..... 242/525, 615, 615.2
See application file for complete search history.

(56) References Cited

U.S. PATENT DOCUMENTS

| | | | | |
|---|---|---|---|---|
| 3,463,377 | A | 8/1969 | Lucas | |
| 3,765,616 | A | 10/1973 | Hutzenlaub et al. | |
| 4,410,122 | A | 10/1983 | Frye et al. | |
| 6,082,660 | A * | 7/2000 | Meyer | 242/548 |

FOREIGN PATENT DOCUMENTS

| | | | |
|---|---|---|---|
| CA | 2066450 | A1 | 1/1992 |
| EP | 0431275 | A2 | 10/1990 |
| EP | 1792858 | A2 | 6/2007 |
| FI | 121306 | | 9/2009 |
| GB | 1336652 | | 11/1973 |
| JP | 5974848 | A | 4/1984 |
| WO | 0174696 | A2 | 10/2001 |

OTHER PUBLICATIONS

European Search Report for EP12182171 dated Nov. 8, 2012, and EPO form 150 (Examination).

* cited by examiner

*Primary Examiner* — Sang Kim
(74) *Attorney, Agent, or Firm* — Stiennon & Stiennon

(57) ABSTRACT

Partial webs are separated in a slitter-winder. The partial webs (WP) are separated by spreading in a spreading device having at least a first, bowed spreader roll (14) fitted at one side of the partial webs (WP) and a second, bowed spreader roll (15) fitted at the opposite side of the partial webs. The partial webs (WP) are guided over the bowed spreader rolls (14, 15) so that the wrap angles (B 14, B15) over the spreader rolls (14, 15) are substantially unequal. The partial webs (WP) are guided to the first spreader roll (14) in a lead-in direction (Dinxy) in the XY-direction and the partial webs are guided from the second spreader roll (15) in a lead-out direction (Doutxy) in the XY-direction such that the lead-in direction (Dinxy) and the lead-out direction are substantially divergent.

10 Claims, 3 Drawing Sheets

METHOD FOR SEPARATING PARTIAL WEBS IN A SLITTER WINDER

CROSS REFERENCES TO RELATED APPLICATIONS

This application claims priority on European Application No. EP1218171, Filed Aug. 29, 2012, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for separating partial webs in a slitter winder. In particular the invention relates to a method for separating partial webs in a slitter-winder, in which method the partial webs are separated by spreading in a spreading device having at least a first, bowed spreader roll fitted at one side of the partial webs and a second, bowed spreader roll fitted at the opposite side of the partial webs.

It is known that a fiber web, e.g. paper, is manufactured in machines which together constitute a paper-manufacturing line which can be hundreds of meters long. Modern paper machines can produce over 450,000 tons of paper per year. The speed of the paper machine can exceed 2,000 m/min and the width of the paper web can be more than 11 meters.

In paper-manufacturing lines, the manufacture of paper takes place as a continuous process. A paper web completing in the paper machine is reeled by a reel-up around a reeling shaft i.e. a reel spool into a parent roll the diameter of which can be more than 5 meters and the weight more than 160 tons. The purpose of reeling is to modify the paper web manufactured as planar to a more easily processable form. On the reel-up located in the main machine line, the continuous process of the paper machine breaks for the first time and shifts into periodic operation.

The web of the parent roll produced in paper manufacture is full-width and even more than 100 km long so it must be slit into partial webs with suitable width and length for the customers of the paper mill and wound around cores into so-called customer rolls before delivering them from the paper mill. This slitting and winding up of the web takes place as known in an appropriate separate machine i.e. a slitter-winder.

On the slitter-winder, the parent roll is unwound, the wide web is slit in longitudinal direction on the slitting section into several narrower partial webs which are wound up on the winding section around winding cores, such as spools, into customer rolls. When the customer rolls are completed, the slitter-winder is stopped and the wound rolls i.e. the so-called set is removed from the machine. Then, the process is continued with the winding of a new set. These steps are repeated periodically until paper runs out of the parent roll, whereby a parent roll change is performed and the operation starts again as the unwinding of a new parent roll.

Slitter-winders employ winding devices of different types, for example multistation winders and carrier roll winders, also called two drum winders. In the carrier roll winders the partial webs are wound around winding cores supported by two carrier rolls to partial web rolls via a nip between the carrier rolls and the partial fiber web roll being formed. In the carrier roll winders also a belt arrangement i.e. a so-called set of belt rolls located around two guide rolls can be used as the carrier roll. On slitter-winders of the multistation winder type, the web is guided from the unwinding via guide rolls to the slitting section where the web is slit into partial webs which are further guided to the winding roll/rolls on the winding stations into customer rolls to be wound up onto cores. Adjacent partial webs are wound up on different sides of the winding roll or on different winding rolls. Multistation winders have one to three winding rolls and in them each partial web is wound to a partial web roll in winding stations. During winding a winding nip is formed between the winding roll and the partial web roll to be wound.

In the following description and claims, the term carrier roll is used for simplicity when referring to a support roll or set of rolls of a windup of carrier roll type i.e. including both a carrier roll and a set of belt rolls. Additionally in this description, the term core means also other types of winding tubes used and suitable for use in windups of carrier roll type. Furthermore in this description, partial webs being wound on the winder and partial web rolls being formed are referred to, according to context, either in singular or plural referring to partial webs and web rolls handled in the winder.

In the slitter-winders after the slitting of the fiber web into the partial fiber webs the partial fiber webs are guided via a separating device to the winding device, which separating device separates apart the partial fiber webs in lateral direction in order to avoid the overlap of partial webs and to set the path of partial webs to correct position for winding and in carrier roll winders, so that the partial web rolls to be wound do not adhere to each other at their ends. Typically the length of each winding core corresponds to the width of the partial web to be wound. The separation of the partial fiber webs is usually performed by means of spreading of the partial webs in the lateral direction such that the partial webs will be after the spreading a distance apart from each other. In the spreading of the partial webs, the objective is to perform the lateral shifting of the partial web such that lateral gliding of the partial web on the spreader member is avoided. This is accomplished by guiding the web by means of a first spreader member which deflects the partial webs outwardly toward the sides of the first spreader member, and by means of a second spreader member which restores the partial webs to the original direction. In prior art as spreader members for example rods, beams, rolls or revolving roll mantles mounted on an axis bent into curved form are employed. A revolving roll mantle may be composed of rigid mantle units or continuous and elastic mantle units. The mantle units may also be separate.

As described above there are many types of spreading system in common use. Some have a single element, while others have two or more elements. A dual bowed roller spreader uses two conventional fixed bow spreaders to produce some very powerful spreading effects and its primary use is after slitting. The dual spreader arrangement allows a folding type of web separation and the dual spreader assembly maintains an equal path length from unwind to windup and thus does not affect the web tension profile. The dual spreader is the most powerful device to separate the cut webs and to create desired narrow gaps between the wound rolls.

As is well known from the prior art the extent of the separation distance between the partial webs is adjusted by altering the curve radius or by altering the distance between the spreader members or by altering the wrap angle of the partial web. If the adjustment is made by altering the curve radius of the spreader member used in spreading the partial webs, high precision is needed, since even a little change in the curve radius has a strong effect on the distance between the partial webs. The most common way of adjusting the separation distance between the partial webs is to adjust the angle of wrap of the web across the spreader members or the rolls. Thus the web makes a steeper or less steep angle when it passes over the spreader members or the rolls, whereby the separation distance between the partial webs is changed. When the angles of wrap of the web at the spreader members or rolls are changed, the directional angles of the arcs relative to the web are also altered. An error in the directional angle of the arc causes a lateral component of rolling in the partial web, which causes problems, because this creates friction force, which tend to move the partial web sideways off from the paths of the partial webs, when rotating rolls are used as spreader members.

The prior art discloses different arrangements and methods for separating partial webs by spreading devices. For example in EP patent publication 0431275 is disclosed a device for spreading of partial webs comprising a first, bowed, revolving roll fitted at one side of the web and a second, bowed, revolving roll fitted at the opposite side of the web, as well as a swing mechanism, which is fitted to act upon said rolls so as to alter the wrap, i.e. deflection angles, of the component webs and thereby to produce the desired spreading of the component webs. The device is provided with a regulation mechanism, which is fitted to correct the directional angles between said rolls and the web to the desired values with all values of the deflection angle.

In U.S. Pat. No. 3,765,616 is disclosed an apparatus to laterally space a plurality of strips which have been slit from a relatively wide web to enable individual rewinding of the strips. The apparatus comprises lead-in and lead-out rollers with a pair of guides disposed between said rollers, said guides being arcuate transversely of the plurality of strips. The arcuate guides serve to twist the strips from a coplanar relationship and to deviate their paths from each other and then twist them back into coplanar but spaced relationship. The guides are angularly adjustable to arrange the arcs in predetermined relationship with respect to each other and to the lead-in and lead-out rollers respectively and also are supported by pivotably mounted arms or frames to adjust the degree of arc to which the strips are subject.

In CA patent publication 2,066,450 is disclosed an apparatus for spreading (broad-drawing) of webs with two curved spreading elements that are rolled shaped in the wrap-around area and coupled to each other and supported pivotably in a frame. The spreading elements are each secured to the coupling element of a four-bar linkage, the two driving levers of the two four-bar linkage being coupled with each other through a gearing system so as to be pivotable in the same direction.

In U.S. Pat. No. 3,463,377 is disclosed a mechanism for separating strips of a traveling web comprising first and second supporting means having support areas positioned to form an arc. The mechanism comprises also first arc changing means connected to the first supporting means for changing the curvature of the arc thereof and second arc changing means connected to the second supporting means for changing the arc thereof, whereby the separating effect of said supporting means can be adjustably controlled.

In F1 patent publication 121306 is disclosed a device for separating partial webs comprising at least a first, bowed roll fitted at one side of the web and a second, bowed roll fitted at the opposite side of the web, as well as a mechanism, which is fitted to act upon said rolls so as to alter the wrap angles of the component webs and thereby to produce the desired spreading of the component webs. The device is provided with a regulation mechanism, which is fitted to change the distance between the first and the second roll dependent of the effecting deflection angle of the partial webs and thus creating the desired separation of the partial webs. The mechanism is a swing mechanism and it is adapted to increase the distance between the first and second rolls simultaneously when the deflection angles of the partial webs is increased.

In prior art methods using a deflection spreading method for separation of partial webs the deflection spreaders for partial web separation the arcs of the spreader rolls are of fixed form, for example of circular arc form, also the direction of the arcs relative to the web is parallel and the arcs of each of the spreader rolls are substantially the same as well as the deflection over each of the arcs of the spreader rolls is equal and the structure of the adjustment mechanism is such that the web entering the deflection spreading device and the web leaving the deflection spreading device are substantially parallel at all wrap angles.

The prior art deflection spreading devices are functional as such but in some cases due to the layout of the slitter-winder and the path geometry of the web the above types of deflection spreading devices are not applicable in all slitter-winders. In particular problems are caused by the parallel entering and leaving direction of the partial webs to and from the deflection spreading device and position of spreader rolls and adjustment devices influencing the entering and leaving direction, which in practice require a lot of space and thus limit the path geometry of the webs.

SUMMARY OF THE INVENTION

An object of the invention is to create a method for separating the partial webs in which the problems and disadvantages of the prior art are eliminated or at least minimized.

Another object of the invention is to accomplish a method for separating the partial webs in a slitter-winder before the winder which is in particular suitable for those slitter-winders in which the prior art deflection spreading devices cannot be used due to layout and/or path geometry reasons.

In the method according to the invention the partial webs are guided over the spreader rolls so that the wrap angles over the spreader rolls are substantially unequal and that the partial webs are guided to the first spreader roll in lead-in direction in XY-direction and the partial webs are guided from the second spreader roll in lead-out direction in XY-direction such that the lead-in direction and the lead-out direction are substantially divergent.

The X direction corresponds to the main direction of process of the slitter-winder, usually the horizontal main running direction and the Y direction corresponds to the vertical direction in respect to the main running direction and Z direction corresponds to the horizontal cross direction of the main horizontal main running direction. By XY-direction is meant the combined direction of X-direction component and Y-direction component in the XYplane and correspondingly by XZ-direction is meant the combined direction of X-direction component and Z-direction component in the XZ-plane.

According to an advantageous aspect of the method according to the invention the partial webs are guided over the spreader rolls that have arcs of different radius of curvature. The arcs of the spreader rolls may be of circular form or the arcs may have an altering form of curvature with altering radius.

According to an advantageous aspect of the method according to the invention the direction of the arcs is substantially divergent at the spreader rolls.

According to an advantageous aspect of the method according to the invention the radii of the arcs of each of the spreader rolls are substantially different as well as the wrap angle over each arc of each the spreader rolls is unequal.

According to an advantageous feature of the method according to the invention the adjustment of the magnitude of the spreading, i.e. the adjustment of gap width between the partial webs, is such that the direction of the web entering the deflection spreading device and the direction of the web leaving the deflection spreading device are substantially divergent at all wrap angles.

According to an advantageous feature of the invention when the deflection over the spreader rolls is adjusted the distance between the spreader rolls is also changed.

According to an advantageous aspect of the invention in the method the spreading over the spreader roll with larger arc radius is performed such that the wrap angle of the partial webs is larger over that spreader roll.

According to an advantageous aspect of the invention in the method one of the spreader rolls is moved mainly in the Y-direction and the other of the spreader rolls is moved mainly in the X-direction.

According to an advantageous aspect of the invention in the method the first spreader roll is moved mainly in the Y-direction and the second spreader roll is moved mainly in the X-direction.

According to an advantageous aspect of the invention in the method the spreader rolls are moved simultaneously.

As spreader members, preferably spreader rolls are employed but, for example, also spreading rods, beams, rolls or revolving roll mantles mounted on an axis bent into curved form can be employed.

In the following the invention is described in more detail with reference to the accompanying drawing to the details of which the invention is not to be narrowly limited.

DESCRIPTION OF THE PREFERRED EMBODIMENTS

In the figures, the same reference signs are used for corresponding parts and part components unless otherwise mentioned. For the sake of clarity, some reference signs have not been repeated at each similar component and marking in the figures, for example only one of the partial webs has been marked with a reference sign as it is apparent in the figures which the other partial webs are.

Figure 1:
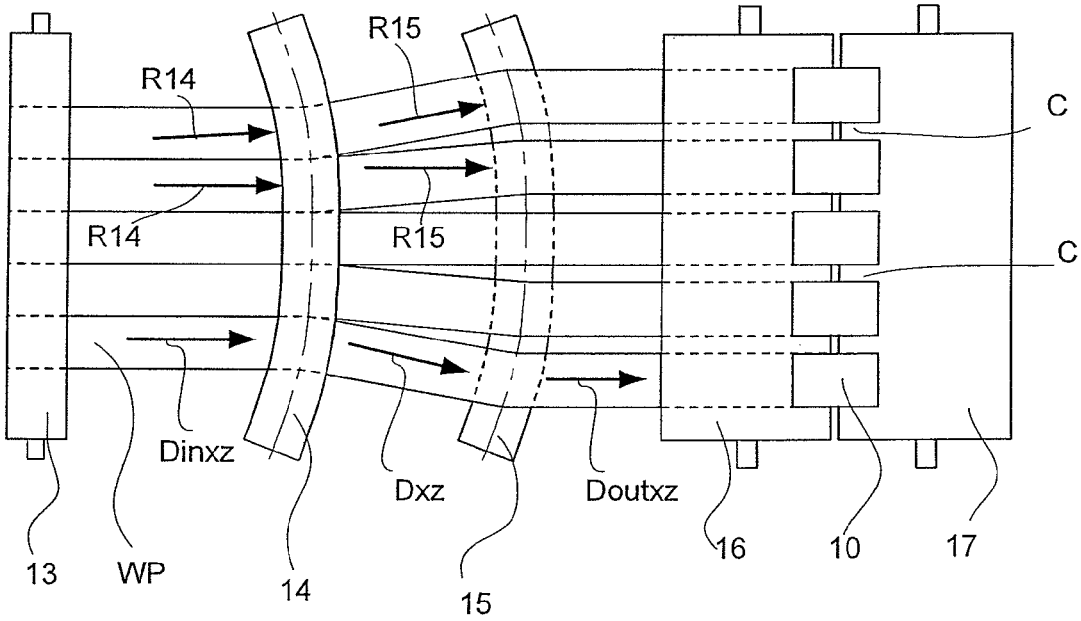
FIG. 1 shows schematically the principle of the deflection spreader as viewed from above in a winder.

In FIG. 1 it is shown schematically how the partial webs W arrive at the first spreader roll 14 from a guide roll 13. The lead-in running direction Dinxz of the partial webs WP in XZ-direction as marked in the figure to the first spreader roll 14 is directly in the direction of the running of the partial webs WP. The partial webs WP are turned around the first bowed spreader roll 14, which has a curvature radius R14 that may be constant or may consist of different radii as shown in the figure. At the first spreader rolls 14 the partial webs WP are deflected outwards in the XZ-direction, each partial web WP in its own direction Dxz. The partial webs WP move laterally apart and a distance between the partial webs WP next to each other is created. Each partial web arrives at the second bowed spreader roll 15 and is turned around the second bowed spreader roll 15, which has a curvature radius R15 that may be constant or may consist of different radii as shown in the figure, to the lead-out direction Doutxz of running of the partial webs WP which corresponds to the lead-in direction Dinxz of the partial webs WP. The partial webs WP are detached from the second spreader roll 15 separated apart with a distance between partial webs WP next to each other and guided for winding at the winding rolls 16, 17 to partial web rolls 10 that are spaced apart such that gaps C are defined between the partial web rolls. The gaps C are provided by separating the partial webs WP by the bowed spreader rolls 14, 15. The partial webs WP are guided over the spreader rolls 14, 15 that have arcs of different radius R14, R15 of curvature. The arcs of the spreader rolls 14, 15 may be of circular form or the arcs may have an altering form of curvature with altering radius.

Figure 2:
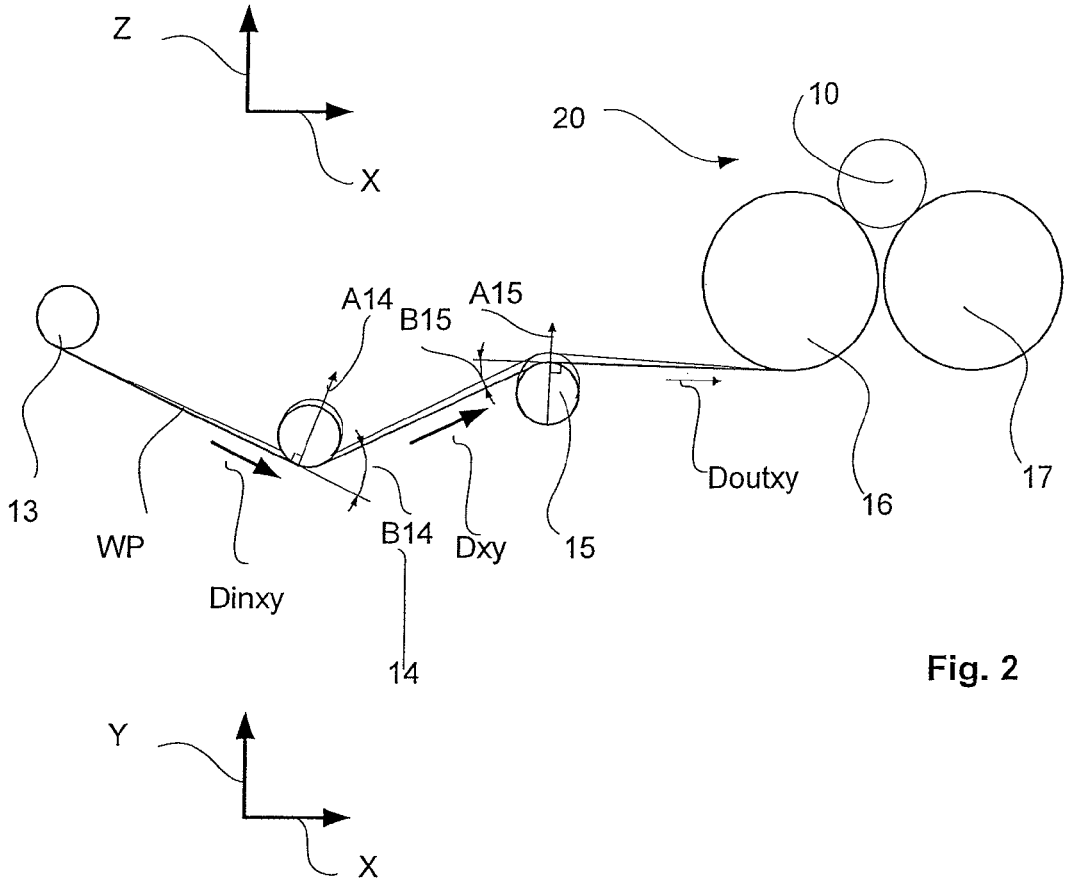
FIG. 2 shows schematically a side view of deflection spreading according to one aspect of the invention in a winder.

In FIG. 2 the partial webs WP are guided from the guide roll 13 under the first spreader roll 14 which separates the partial webs WP apart and a distance between partial webs WP next to each other is created (FIG. 1). From the first spreader roll 14 the partial webs WP are guided above the second spreader rolls 15 and to the winder 20 to be wound to partial web rolls 10 at the winding rolls 16, 17. The lead-in direction Dinxy of the partial webs WP to the first spreader roll 14 is different than the lead-out direction Doutxy in XY-direction and the partial webs WP are guided over the spreader rolls 14, 15 so that the wrap angles B14, B15 over the spreader rolls 14, 15 are substantially unequal and the direction A14; A15 of the arcs is substantially divergent at the first and the second spreader roll 14, 15.

Figure 3:
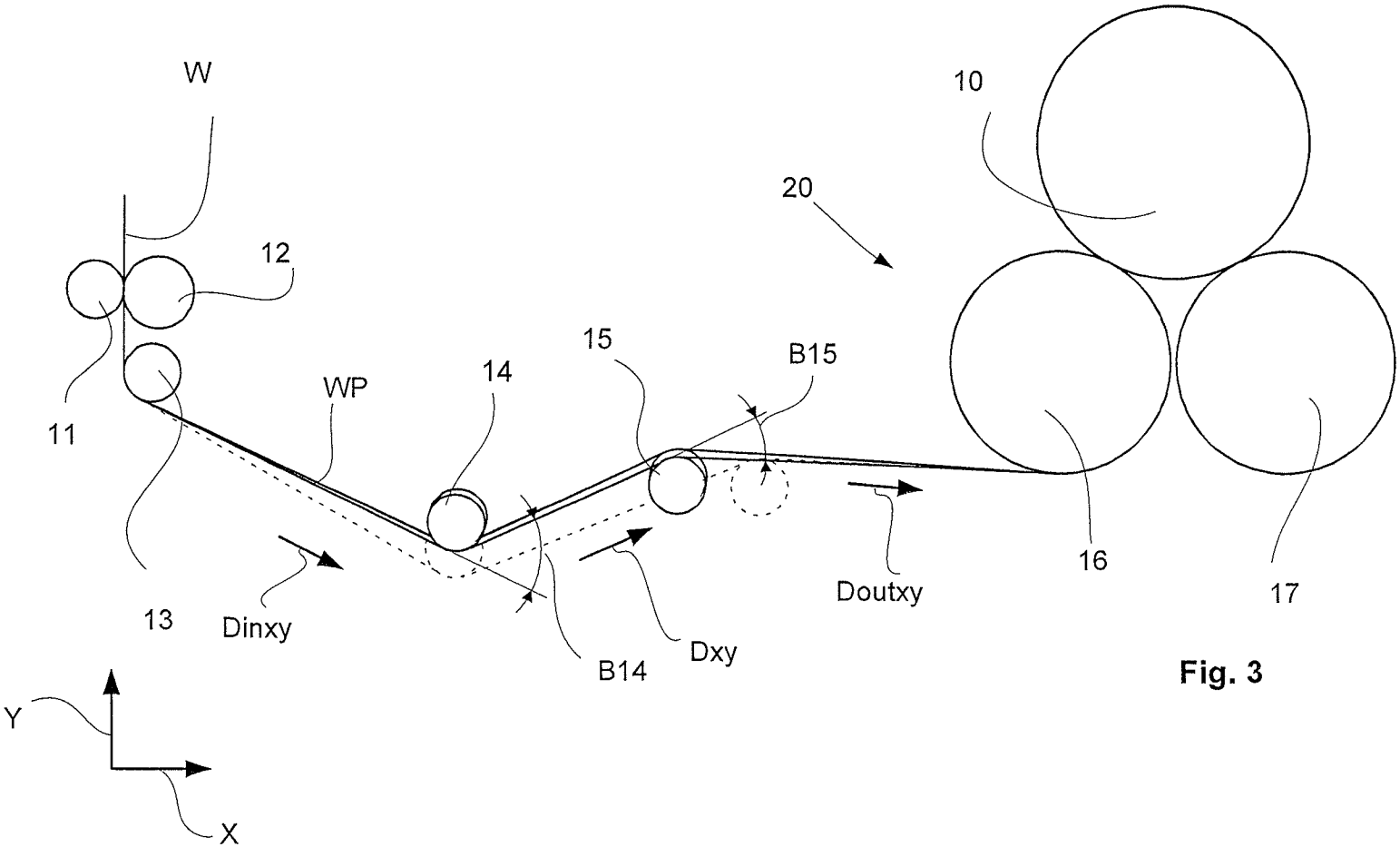
FIGS. 3-4 show schematically side views of deflection spreading according to one aspect of the invention in a winder.
Figure 4:
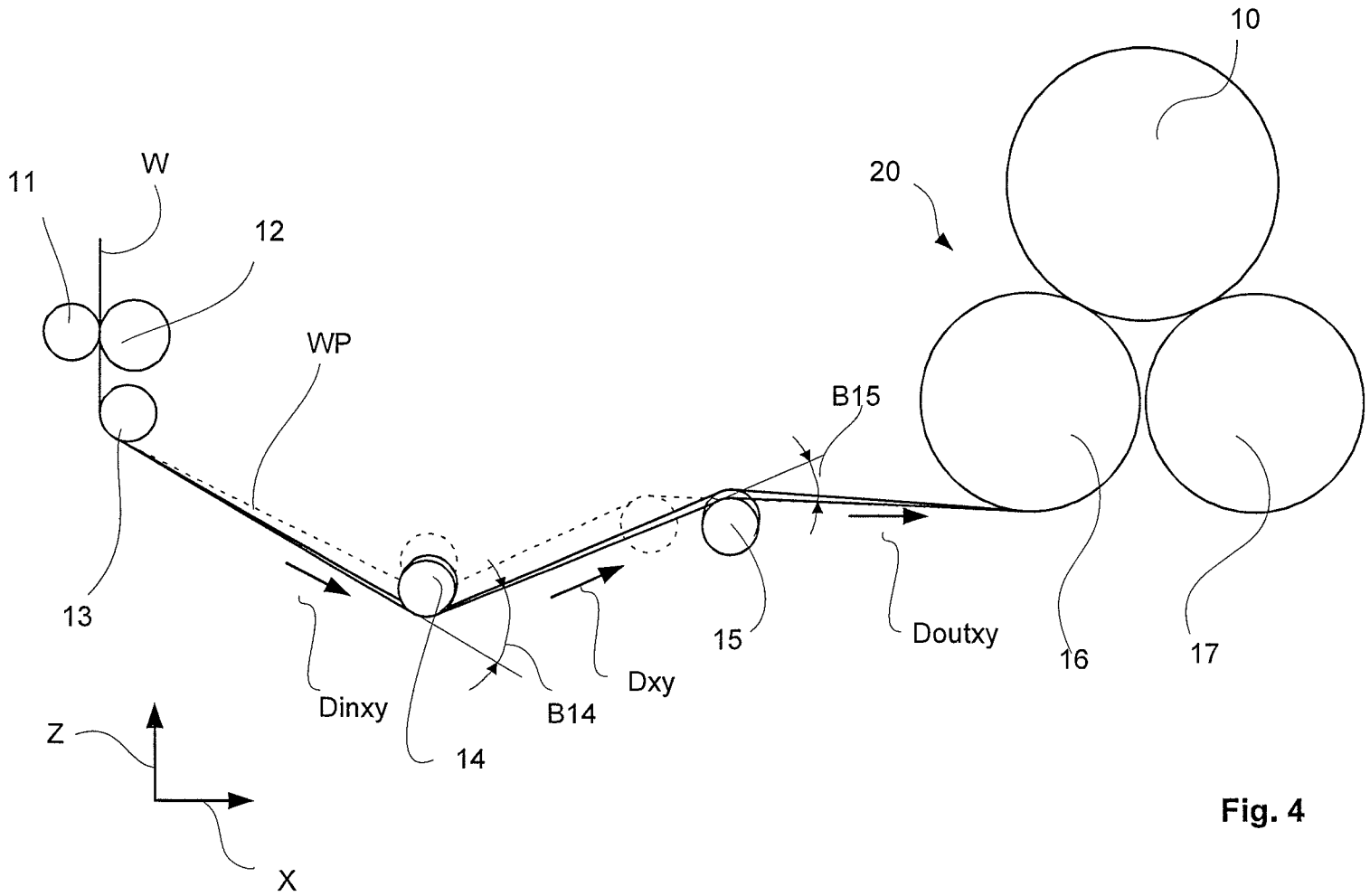

In FIGS. 3-4 the web W is guided into slitting between the slitter blades 11, 12, which slit the web W in the longitudinal direction into partial webs WP. In FIGS. 3 and 4 are schematically shown the extreme positions of the spreader rolls 14, 15 for creating the gap between the partial webs WP. In the position of FIG. 3 the width of the gaps C (FIG. 1) created will be smallest and in the position of FIG. 4 the width of the gaps C will be biggest. In order to adjust the width of the gaps, the first spreader roll 14 is moved mainly vertically, i.e. in the Y-direction, and the second spreader roll is moved mainly horizontally, i.e. in the X-direction. The spreader rolls are advantageously moved simultaneously. The partial webs WP are guided via a guide roll 13 to the spreading device, in which the first spreader roll 14 with an arc turns the partial webs WP and alters their running direction such that a distance is created between the partial webs WP next to each other and the second spreader roll 15 with an arc turns the partial webs back to the original running direction (FIG. 1). After the spreading, the partial webs WP are guided to a carrier roll winder 20 with two carrier rolls 16, 17 to be wound to partial web rolls 10. The lead-in direction Dinxy of the partial webs WP to the first spreader roll 14 is different than the lead-out direction Doutxy in XY-direction and the partial webs WP are guided over the spreader rolls 14, 15 so that the wrap angles B14, B15 over the spreader rolls 14, 15 are substantially unequal and the direction A14; A15 of the arcs is substantially divergent at the first and the second spreader rolls 14, 15. As shown in FIGS. 3 and 4 by dashed lines, as the wrap angle B14, B15 over the spreader rolls 14, 15 is adjusted, the distance between the spreader rolls 14, 15 is also changed.

Above the invention has been described with reference to only some of its advantageous examples to which the invention is not to be narrowly limited. Many modifications and alterations are possible within the inventive idea.

We claim:

1. A method for separating partial webs in a slitter-winder with a spreader device having two bowed rotating spreader rolls, comprising the steps of:

separating the partial webs by spreading in a spreading device, wherein the spreading device has at least a first bowed spreader roll which forms a first arc fitted on one side of the partial webs and a second bowed spreader roll forming a second arc fitted on an opposite side of the partial webs, wherein the first arc has a radius of curvature that is less than a radius of curvature of the second arc;

wherein the first arc is bowed in a first direction and wherein the second arc is bowed in a second direction, and the first direction and the second direction are divergent;

wherein the partial webs move along a web path in the slitter-winder between slitter blades and a winding roll to define a main running direction of the partial webs, wherein the main running direction defines an X-direction, and wherein a Z-direction is defined in a cross direction of the webs as the webs move in the main running direction, and a Y-direction is defined perpendicular to the X-direction and the Z-direction;

wherein the partial webs travel under the first bowed spreader roll and over the second bowed spreader roll and then under the winding roll and then wind on to a plurality of partial web rolls;

wherein the plurality of partial web rolls define gaps therebetween, the gaps located downstream of the first bowed spreader roll and the second bowed spreader roll, the gaps having a width;

increasing the width of the gaps by moving the first bowed spreader roll more in the Y-direction than in the X-direction, so that a wrap angle about the first spreader roll becomes larger, and moving the second bowed spreader roll more in the X-direction than in the Y-direction away from the first spreader roll, so that the first direction and the second direction become more divergent when increasing the widths of the gaps;

decreasing the width of the gaps by moving the first bowed spreader roll more in the Y-direction than in the X-direction so that the wrap angle about the first spreader roll becomes smaller, and moving the second bowed spreader roll more in the X-direction than in the Y-direction toward the first spreader roll so that the first direction and the second direction become less divergent when decreasing the widths of the gaps;

wherein an XY-plane is defined as a plane containing the Y-direction and the X-direction, and a XY-direction is defined as a direction having a X-direction component and a Y-direction component in the XY-plane;

wherein the partial webs are guided over the first spreader roll to wrap the first spreader roll the first wrap angle, and are guided over the second spreader roll to wrap the second spreader roll a second wrap angle, so that the first wrap angle and the second wrap angle are unequal;

wherein the partial webs are guided to the first spreader roll in a lead-in direction in a first XY-direction and the partial webs are guided from the second spreader roll in a lead-out direction in a second XY-direction; and wherein the first XY-direction and the second XY-direction are such that the lead-in direction and the lead-out direction are divergent.

2. The method of claim 1 wherein the main running direction is substantially horizontal.

3. The method of claim 1 wherein the wrap angles over the first and second spreader rolls are adjusted and the distance between the first and second spreader rolls is changed simultaneously.

4. The method of claim 1 wherein the wrap angle of the partial webs is larger over the first spreader roll as compared to the second spreader roll.

5. The method of claim 1 wherein the first bowed spreader roll and the second bowed spreader roll are moved simultaneously.

6. A method for separating partial webs in a slitter-winder with a spreader device having two bowed rotating spreader rolls, comprising the steps of:

separating the partial webs by spreading in a spreading device, the spreading device having at least a first bowed spreader roll which forms a first arc fitted on one side of the partial webs and a second bowed spreader roll which forms a second arc fitted on the opposite side of the partial webs, wherein the first arc has a radius of curvature that is different than a radius of curvature of the second arc;

wherein the first arc is bowed in a first direction and wherein the second arc is bowed in a second direction, and the first direction and the second direction are divergent;

wherein the partial webs move along a web path in the slitter-winder between slitter blades and a winding roll to define a main running direction of the partial webs;

wherein the partial webs move along a web path in the slitter-winder between slitter blades and a winding roll to define a main running direction of the partial webs, wherein the main running direction defines an X-direction, and wherein a Z-direction is defined in a cross direction of the webs as the webs move in the main running direction, and a Y-direction is defined perpendicular to the X-direction and the Z-direction;

wherein the plurality of partial web rolls define gaps therebetween, the gaps located downstream of the first bowed spreader roll and the second bowed spreader roll, the gaps having a width;

increasing the width of the gaps by moving one of the first bowed spreader roll and second bowed spreader roll more in the Y-direction than in the X-direction, so that a wrap angle about the said one spreader roll becomes larger, and moving the other of the first and second bowed spreader rolls more in the X-direction than in the Y-direction away from said one spreader roll so that the first direction and the second direction become more divergent when increasing the widths of the gaps;

decreasing the width of the gaps by moving said one of the first bowed spreader roll and second bowed spreader rolls more in the Y-direction than in the X-direction, so that a wrap angle about the one said spreader roll becomes smaller, and moving the other of said first and second bowed spreader rolls more in the X-direction than in the Y-direction toward said one spreader roll so that the first direction and the second direction become less divergent when decreasing the widths of the gaps.

7. The method of claim 6 wherein the main running direction is substantially horizontal.

8. The method of claim 6 wherein the wrap angles of the partial webs over the first and second spreader rolls is adjusted and the distance between the first and second spreader rolls is changed simultaneously.

9. The method of claim 6 wherein the wrap angle of the partial webs is larger over the first spreader roll as compared to the second spreader roll.

10. The method of claim 6 wherein the first bowed spreader roll and the second bowed spreader roll are moved simultaneously.

* * * * *